US008155363B2

(12) United States Patent
Suzuki

(10) Patent No.: US 8,155,363 B2
(45) Date of Patent: Apr. 10, 2012

(54) ELECTRICAL HORN

(75) Inventor: Koji Suzuki, Hamamatsu (JP)

(73) Assignee: HAMANAKODENSO CO., LTD., Shizuoka-pref. (JP)

( * ) Notice: Subject to any disclaimer, the term of this patent is extended or adjusted under 35 U.S.C. 154(b) by 303 days.

(21) Appl. No.: 12/588,230

(22) Filed: Oct. 8, 2009

(65) Prior Publication Data

US 2010/0119096 A1 May 13, 2010

(30) Foreign Application Priority Data

Nov. 13, 2008 (JP) ..... 2008-291202

(51) Int. Cl.
*H04R 1/20* (2006.01)

(52) U.S. Cl. ..... 381/340; 381/338

(58) Field of Classification Search ..... 181/152, 181/159; 381/338, 339, 340, 341, 342
See application file for complete search history.

(56) References Cited

U.S. PATENT DOCUMENTS

| | | | | |
|---|---|---|---|---|
| 2,689,543 A | | 4/1952 | Lemmon | |
| 4,441,099 A | * | 4/1984 | Neese | 181/152 |
| 5,703,335 A | | 12/1997 | Deutsch | |
| 6,754,360 B2 | * | 6/2004 | Granziera | 381/340 |
| 2008/0238043 A1 | | 10/2008 | Chlystek | |

FOREIGN PATENT DOCUMENTS

| | | | |
|---|---|---|---|
| DE | 565 953 | | 12/1932 |
| FR | 2 607 951 | | 6/1988 |
| GB | 491510 | | 9/1938 |
| JP | 2008089627 | * | 4/2008 |
| JP | A-2008-89627 | | 4/2008 |
| JP | EP 2 065 884 A2 | | 6/2009 |
| WO | WO 01/57848 A1 | | 8/2001 |

OTHER PUBLICATIONS

European Search Report mailed on Mar. 15, 2011 issued in the corresponding German Patent Application No. 09 012 706.9-2213.
Extended European Search Report dated Apr. 14, 2010 issued from the European Patent Office in the corresponding European patent application No. 09012706.9-2213.

* cited by examiner

*Primary Examiner* — Brian Ensey
(74) *Attorney, Agent, or Firm* — Posz Law Group, PLC

(57) ABSTRACT

An electrical horn includes a horn housing, an oscillation member located at the horn housing to generate a sonic wave, and a resonance tube in which the sonic wave generated by the oscillation member flows. In the electrical horn, the resonance tube has a plurality of sonic outlet portions that are open in different directions. Accordingly, when the electrical horn is mounted to a vehicle, it is possible to reduce an amount of foreign material entering into the resonance tube while increasing a sonic pressure toward a vehicle front side.

20 Claims, 9 Drawing Sheets

ELECTRICAL HORN

CROSS REFERENCE TO RELATED APPLICATION

This application is based on Japanese Patent Application No. 2008-291202 filed on Nov. 13, 2008; the contents of which are incorporated herein by reference in its entirety.

FIELD OF THE INVENTION

The present invention relates to an electrical horn (e.g., a warning horn) used for a vehicle such as an automobile, a bus, a truck or the like.

BACKGROUND OF THE INVENTION

Generally, a horn for a vehicle is provided with a scroll-type or a trumpet-type resonance tube.

For example, in an electrical horn, an oscillation plate oscillates by a solenoid force to generate a sonic wave for oscillating air, and the sonic wave is amplified in a resonance tube. That is, the air oscillation generated by the oscillation plate is transmitted to an exterior of the electrical horn through a sonic passage inside the resonance tube. The resonance tube is a scroll-type resonance tube or a trumpet-type resonance tube, which has an open end portion used as a sonic outlet portion.

The electrical horn is generally attached to a vehicle such that the sonic outlet portion is open toward downwardly, so as to restrict foreign material such as water from entering into the resonance tube from the sonic outlet portion. When the sonic outlet portion is open toward downwardly, a sonic pressure toward a vehicle front side is reduced. Furthermore, even if the sonic outlet portion is open toward downwardly, droplet in vehicle running or water in vehicle washing may be entered into the resonance tube from the sonic outlet portion and may stay in the resonance tube.

JP 2008-89627A proposes an electrical horn configured to reduce the foreign material flowing therein. The electrical horn includes a reflection member configured by a back plate and a bottom plate. The back plate has a through hole and extends to a bottom side of the sonic outlet portion, and the bottom plate extends from the back plate to the vehicle front side, in the reflection member.

In the electrical horn described in JP 2008-89627A, foreign materials flying from the front side moves to the rear side after passing through the through hole of the back plate, and thereby it is necessary to make the through hole to be larger in order to reduce the foreign material staying in the electrical horn. In contrast, the through hole of the back plate needs to be smaller in order to increase the sonic pressure, toward the vehicle front side. That is, the dimension of the through hole has a trade-off relation between an increase of the sonic pressure and a reduction of the foreign material. Therefore, it is difficult to increase the sonic pressure while effectively reducing the foreign material entering into a resonance tube of the electrical horn. Furthermore, the foreign material entering the resonance tube from the sonic outlet portion may flow deeply into the resonance tube. In addition, because the reflection member protrudes downwardly from the sonic outlet portion, the outer dimension of the electrical horn may become larger, and the electrical horn may be difficult to be mounted to a vehicle having a small mounting dimension.

SUMMARY OF THE INVENTION

In view of the foregoing problems, it is an object of the present invention to provide an electrical horn having at least two sonic outlet portions.

It is another object of the present invention to provide an electrical horn for a vehicle, which can reduce an amount of foreign material entering into a resonance tube while increasing a sonic pressure toward a vehicle front side, when the electrical horn is mounted to the vehicle.

According to an aspect of the present invention, an electrical horn includes a horn housing, an oscillation member located at the horn housing to generate a sonic wave, and a resonance tube in which the sonic wave generated by the oscillation member flows. In the electrical horn, the resonance tube has a plurality of sonic outlet portions that are open in different directions. Accordingly, when the electrical horn is mounted to a vehicle, it is possible to reduce an amount of foreign material entering into the resonance tube while increasing a sonic pressure toward a vehicle front side.

For example, the plurality of sonic outlet portions may be two sonic outlet portions that are open respectively in two wall surfaces of the resonance tube, facing in different directions. Furthermore, at least one of the sonic outlet portions may be provided with plural openings.

The oscillation member may be an oscillation plate member located between the horn housing and a cover member that is spaced from the oscillation plate member to be approximately parallel with the oscillation plate member. Furthermore, the resonance tube may include a scroll portion defining a sonic passage between the cover member and a parallel wall portion extending approximately in parallel with the cover member, and a trumpet portion continuously extending from the scroll portion to define the sonic passage. In this case, a passage sectional area of the sonic passage of the scroll portion is gradually increased toward downstream, and a passage sectional area of the sonic passage of the trumpet portion is rapidly increased. Furthermore, the trumpet portion has an orthogonal wall surface that extends from the parallel wall portion approximately perpendicularly to a surface of the parallel wall portion to define the sonic passage, and at least two of the sonic outlet portions are open in the trumpet portion to face in different directions.

For example, one of the sonic outlet portions may be open at a tip end of the trumpet portion, and the other one of the sonic outlet portions may be open in the orthogonal wall surface. In this case, the electrical horn may include a shielding plate located to cover a part of the one sonic outlet portion provided at the tip end of the trumpet portion. Furthermore, the shielding plate may cover a part of the one sonic outlet portion at the tip end of the trumpet portion, on a side near the sonic outlet portion provided in the orthogonal wall surface.

Alternatively, a tip end of the trumpet portion may be fully closed. In this case, one of the sonic outlet portions may be open in the orthogonal wall surface of the trumpet portion, and the other one of the sonic outlet portions may be open in a wall surface of the trumpet portion, other than the orthogonal wall surface.

The resonance tube may further include a protruding wall part protruding from the parallel wall portion approximately perpendicularly to a surface of the parallel wall portion to be opposite to the orthogonal wall surface.

The orthogonal wall surface may be provided in a part of the parallel wall portion such that a protruding dimension protruding from the parallel wall portion is gradually increased as toward a tip end of the trumpet portion in a first circumferential direction. Furthermore, the protruding wall part may be provided in a part of the parallel wall portion such that a protruding dimension protruding from the parallel wall portion is gradually increased as toward the tip end of the trumpet portion in a second circumferential direction opposite to the first circumferential direction.

Furthermore, the trumpet portion may include a cover part that protrudes from a wall surface approximately perpendicular to the orthogonal wall surface and covers a part of the parallel wall portion. In addition, the orthogonal wall surface and the cover part may be configured together with the parallel wall portion to define an opening.

Alternatively, the resonance tube may include a protruding wall part protruding from the parallel wall portion approximately perpendicularly to a surface of the parallel wall portion to be opposite to the orthogonal wall surface, and the cover part and protruding wall part may define an opening that is larger than an open area of the sonic outlet portion provided in the orthogonal wall surface.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Embodiments and modifications of the present invention will be described with reference to the accompanying drawings.

First Embodiment

A first embodiment and modifications thereof according to the present invention will be described with reference to FIGS. 1 to 8.

Figure 1:
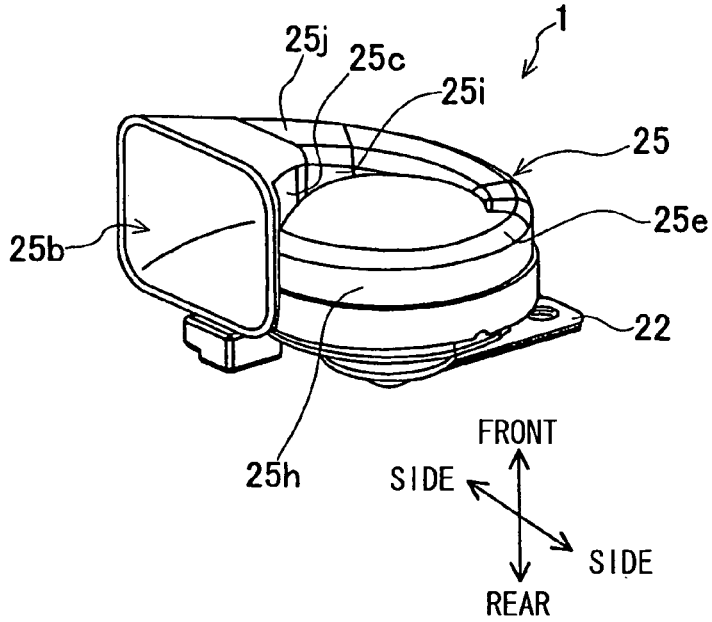
FIG. 1 is a perspective view showing an example of an electrical horn according to a first embodiment of the present invention.
Figure 2A:
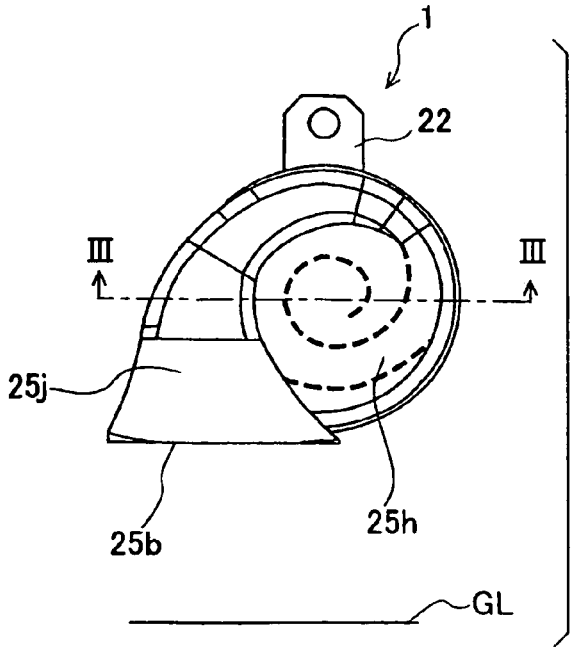
FIGS. 2A and 2B are a front view and a side view, showing the electrical horn shown in FIG. 1, in a state mounted to a front grill of a vehicle.
Figure 2B:
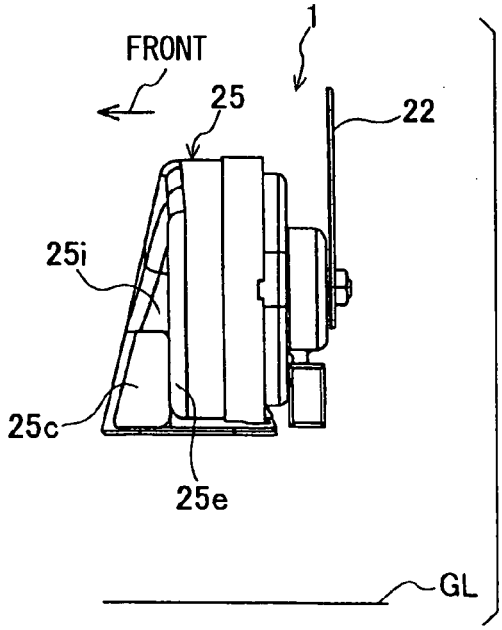
Figure 3:
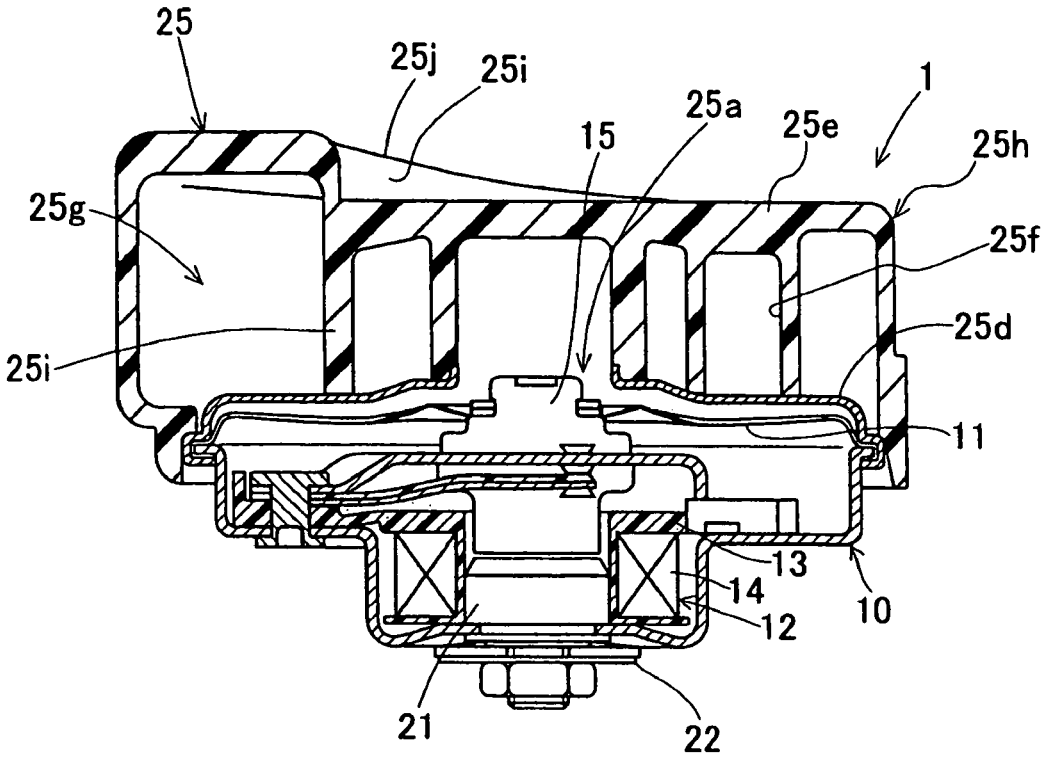
FIG. 3 is a cross-sectional view taken along the line of FIG. 2.

FIG. 1 is a perspective view showing an example of an electrical horn 1 according to the first embodiment of the present invention, FIGS. 2A and 2B are a front view and a side view showing the electrical horn 1 shown in FIG. 1 in a state mounted to a front grill of a vehicle, and FIG. 3 is a cross-sectional view taken along the line of FIG. 2A.

The electrical horn 1 shown in FIGS. 1 to 3 includes a horn housing 10, an oscillation member 11 fixed to the horn housing 10 to generate a sonic wave, and a resonance tube 25 connected to the horn housing 10 to enclose the oscillation member 11. The resonance tube 25 is provided with a sonic inlet portion 25*a*, and two sonic outlet portions 25*b*, 25*c*. As shown in FIGS. 2A and 2B, the two sonic outlet portions 25*b*, 25*c* have open surfaces facing toward two different directions. That is, the sonic outlet portions 25*b*, 25*c* are open toward in two different directions. In FIGS. 2A and 2B, GL indicates a ground line (ground surface) when the electrical horn 1 is mounted to a vehicle. In the example of FIGS. 2A and 2B, the sonic outlet portion 25*b* is open toward downwardly, and the sonic outlet portion 25*c* is open toward a vehicle side substantially perpendicular to the open direction of the sonic outlet portion 25*b*.

An electromagnet 12 configured to generate an electromagnetic force and to oscillate the oscillation member 11, a fixed core 21 and the like are accommodated in the horn housing 10. A stay 22 is fixed to the horn housing 10, and the horn housing 10 is fixed to a vehicle (not shown) by using the stay 22.

The electromagnet 12 is provided with a coil 14 wound a bobbin 13, and a lower portion of a movable core 15 is located in a center hole portion of the bobbin 13. A center portion of the oscillation member 11 is fastened to an upper portion of the movable core 15, and an outer peripheral portion of the oscillation member 11 is wound to and fastened to an outer peripheral end portion of the horn housing 10.

The cover member 25*d* is spaced from the oscillation member 11 and is arranged approximately in parallel with the oscillation member 11 at a side opposite to the horn housing 10 with respect to the oscillation member 11. The outer peripheral end portion of the cover member 25*d* is wound and fastened to the outer peripheral end portion of the horn housing 10 to be overlapped with the outer peripheral end portion of the oscillation member 11 and the outer peripheral end portion of the horn housing 10. That is, the outer peripheral end portion of the cover member 25*d* is bent to have a recess portion, and the outer peripheral end portions of the oscillation member 11 and the horn housing 10 are inserted into the recess portion to be fastened and fixed to the outer peripheral end portion of the cover member 25*d*. The sonic inlet portion 25*a* is provided at a center area of the cover member 25*d*.

The resonance tube 25 includes a scroll portion 25*h* defining therein a scroll sonic passage 25*g*. The scroll sonic passage 25*g* is formed between the cover member 25*d* and a parallel wall portion 25*e* extending approximately in parallel with the cover member 25*d*, such that a passage sectional area 25*f* (e.g., rectangular sectional area) is gradually increased in the scroll sonic passage 25*g*. A trumpet portion 25*j* is provided integrally with the scroll portion 25*h* such that the passage sectional area 25*f* is rapidly increased in the trumpet portion 25*j* as toward the sonic outlet portion 25*b*. The trumpet portion 25*j* includes an orthogonal wall surface 25*i* for defining the sonic passage 25*g*, and the orthogonal wall surface 25*i* is provided to protrude approximately perpendicularly from a surface of the parallel wall portion 25*e*. That is, the trumpet portion 25*j* is integrally provided with the scroll portion 25*h* to continuously define the sonic passage 25*g* in the resonance tube 25.

The sonic outlet portion 25*b* is fully opened at a tip end portion of the trumpet portion. In contrast, the sonic outlet portion 25*c* is provided in the orthogonal wall surface 25*i* that protrudes approximately perpendicularly from the parallel wall portion 25*e*, at a position close to the tip end portion of the trumpet portion 25*j*.

In the example of the electrical horn 1 having the above-described structure shown in FIGS. 1 to 3, a sonic wave (i.e., air oscillation) transmitted from the sonic inlet portion 25*a* is amplified while passing through the sonic passage 25*g*, and is exited from the sonic outlet portions 25*b*, 25*c*. Generally, the electrical horn 1 is mounted to a vehicle in a state shown in FIGS. 2A and 2B. The sonic outlet portion 25*b* opened at the tip end portion of the trumpet portion 25*j* faces toward downwardly (i.e., the ground surface GL), and the parallel wall portion 25*e* faces toward the vehicle front side. Therefore, the sonic outlet portion 25*c* is open toward a vehicle side, as shown in FIG. 2B. Thus, both the sonic outlet portion 25*b* and the sonic outlet portion 25*c* are not open toward the vehicle front side, thereby preventing foreign materials from directly flying into the sonic outlet portions 25*b* and 25*c* from the vehicle front side.

Because the parallel wall portion 25*e* is provided to face toward the vehicle front side, a part of the sonic wave flowing out of the sonic outlet portion 25*c* is reflected by the parallel wall portion 25*e* toward the vehicle front side, thereby increasing the sonic pressure toward the vehicle front side. In the example of FIGS. 2A and 2B, the sonic outlet portion 25*b* is open toward downwardly, and the sonic outlet portion 25*c* is open toward a vehicle side in a vehicle right-left direction.

Foreign material entering from the sonic outlet portion 25*b* can be discharged from the sonic outlet portion 25*c* to an exterior of the resonance tube 25, thereby effectively reducing the foreign material staying in the resonance tube 25. Similarly, foreign material entering from the sonic outlet portion 25*c* can be discharged from the sonic outlet portion 25*b* to the exterior of the resonance tube 25, thereby effectively reducing the foreign material staying in the resonance tube 25.

The electrical horn 1 according to the first embodiment is not limited to the example shown in FIGS. 1 to 3, and can be suitably modified. For example, in the example of FIG. 1, the sonic outlet portion 25*c* may be provided in a wall surface that defines the sonic passage 25*g* of the trumpet portion 25*j* and faces toward a vehicle side in the vehicle left-right direction. Alternatively, in the example of FIG. 1, the sonic outlet portion 25*c* may be provided in a wall surface that defines the sonic passage 25*g* of the trumpet portion 25*j* and faces toward a vehicle rear side. Alternatively, in the example of FIG. 1, the sonic outlet portion 25*c* may be provided in a wall surface that defines the sonic passage 25*g* of the trumpet portion 25*j* and faces toward a vehicle front side.

Figure 4:
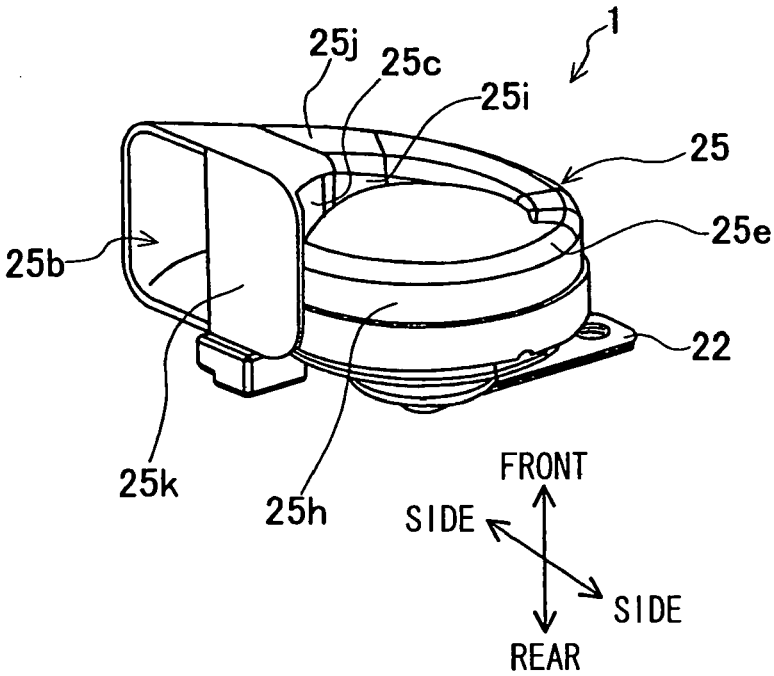
FIG. 4 is a perspective view showing another example of an electrical horn according to the first embodiment.
Figure 5A:
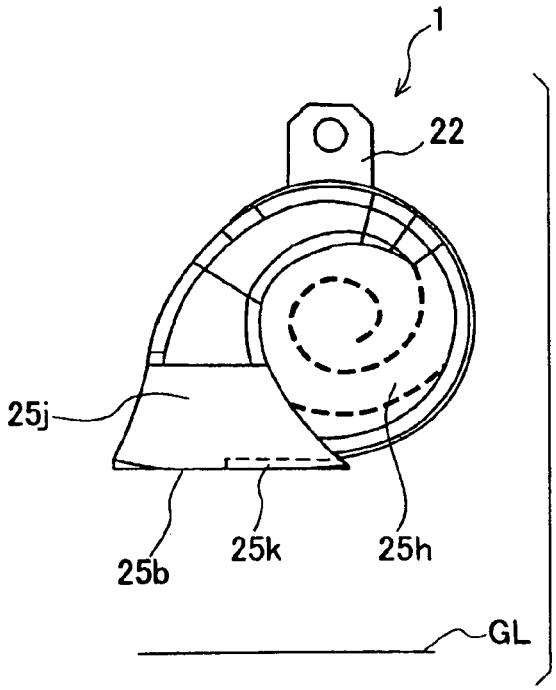
FIGS. 5A and 5B are a front view and a side view showing the electrical horn shown in FIG. 4, in a state mounted to a front grill of a vehicle.
Figure 5B:
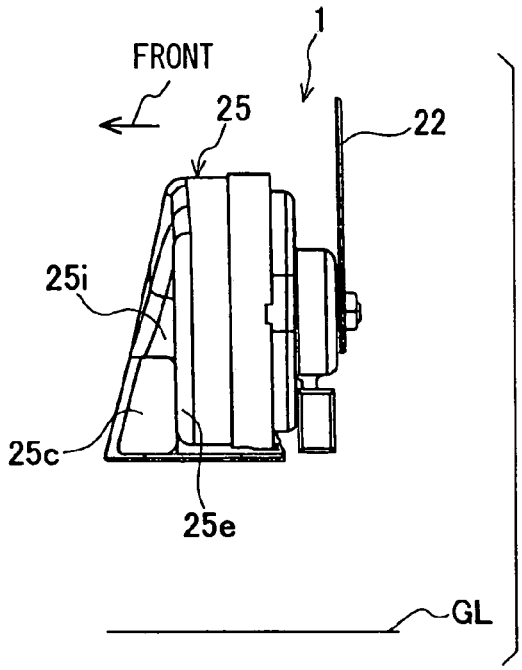

FIGS. 4, 5A and 5B show another example of an electrical horn 1 of the first embodiment, in which a part of the sonic outlet portion 25*b* provided at the tip end portion of the trumpet portion 25*j* is closed by a shielding plate 25*k*. In the example of FIGS. 4, 5A and 5B, a right half area of the sonic outlet portion 26*b* at the tip end portion of the trumpet portion 25*j*, at a side near the sonic outlet portion 25*c*, is closed by the shielding plate 25*k*. Therefore, the sonic wave reflected by the shielding plate 25*k* can effectively flow out of the sonic outlet portion 25*c*. Thus, a part of the sonic wave flowing out of the sonic outlet portion 25*c* is reflected by the parallel wall portion 25*e* toward the vehicle front side, thereby further improving the sonic pressure toward the vehicle front direction.

Figure 6A:
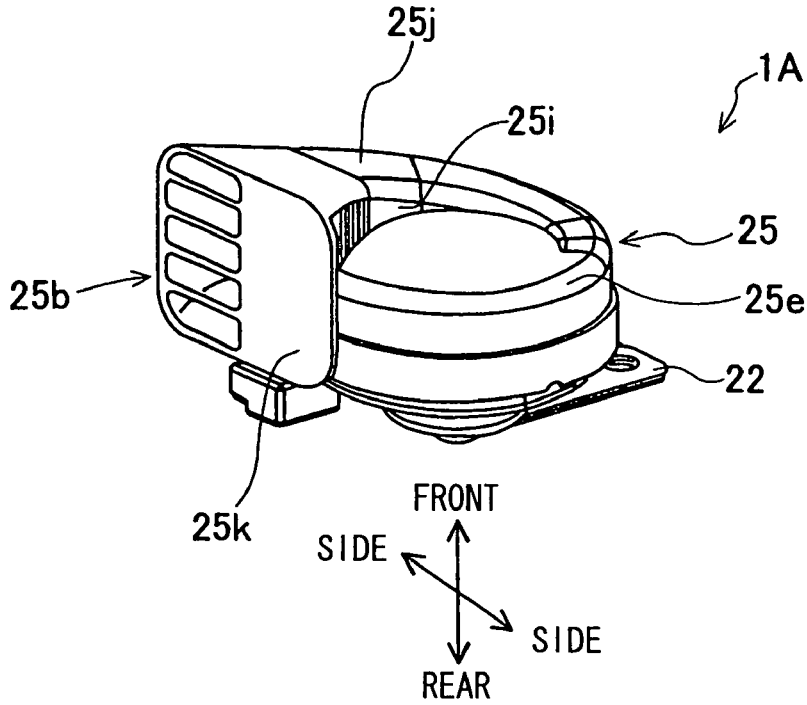
FIGS. 6A and 6B are a perspective view and a side view showing another example of an electrical horn according to the first embodiment.
Figure 6B:
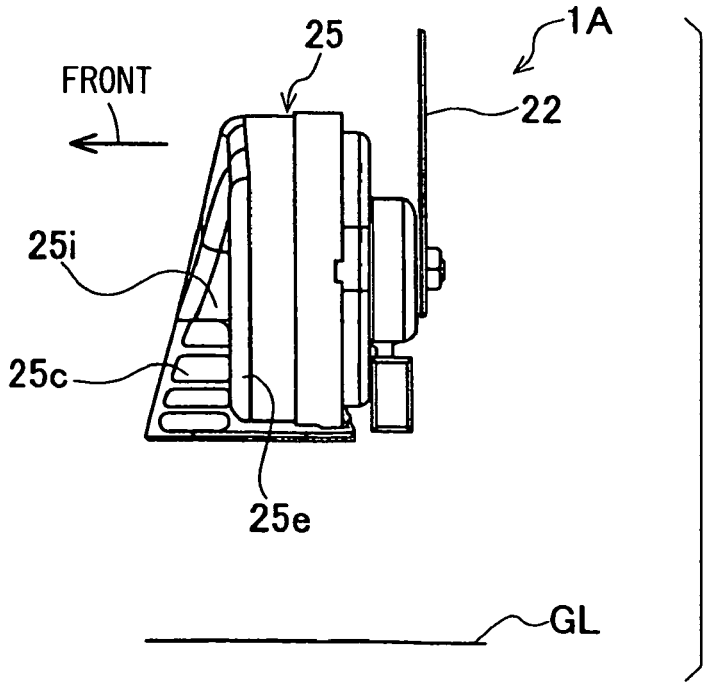

FIGS. 6A and 6B show another example of an electrical horn 1A of the first embodiment, in which a plurality of sonic outlet portions 25*b* and a plurality of sonic outlet portions 25*c* are respectively opened. In this case, the amount of foreign material flowing into the resonance tube 25 from the sonic outlet portions 25*b* and 25*c* can be further reduced. Furthermore, as shown in FIG. 6A, the shielding plate 25*k* can be provided to close a part of the sonic outlet portions 25*b* at the tip end portion of the trumpet portion 25*j*. Therefore, the amount of foreign material flowing into the resonance tube 25 from the sonic outlet portions 25*b* can be more effectively reduced.

Figure 7:
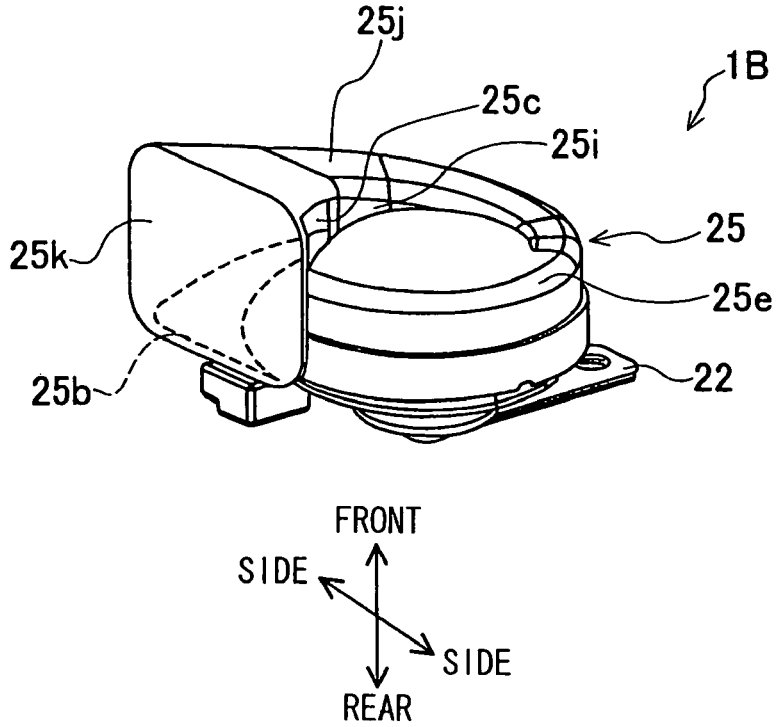
FIG. 7 is a perspective view showing another example of an electrical horn according to the first embodiment.

FIG. 7 shows another example of an electrical horn 1B of the first embodiment, in which the tip end portion of the trumpet portion 25*j*, generally used as a sonic outlet portion, is completely closed by a shielding plate 25*k*. In the example of the electrical horn 1B shown in FIG. 7, the sonic outlet portion 25*b* is provided in a wall surface that defines the sonic passage 25*g* of the trumpet 25*j* and faces toward a vehicle rear side, and the sonic outlet portion 25*c* is provided in the wall surface that defines the sonic passage 25*g* of the trumpet 25*j* and faces toward a vehicle side in the vehicle left-right direction. In this case, because the sonic outlet portions 25*b* and 25*c* are open in the vehicle rear direction and the vehicle side direction which are different from each other, thereby improving the sonic pressure in the vehicle front direction and reducing the amount of the foreign material entering the resonance tube 25.

Figure 8:
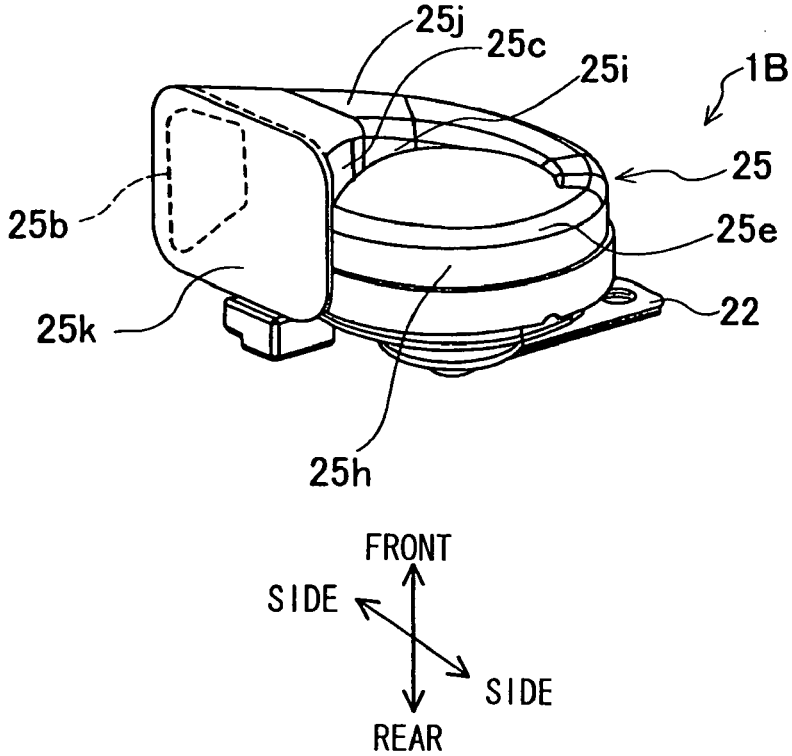
FIG. 8 is a perspective view showing another example of an electrical horn according to the first embodiment.

FIG. 8 shows another example of an electrical horn 1B of the first embodiment, in which the tip end portion of the trumpet portion 25*j*, generally used as a sonic outlet portion, is completely closed by a shielding plate 25*k*. In the example of the electrical horn 1B of FIG. 8, a sonic outlet portion 25*b* is provided in a wall surface that defines the sonic passage 25*g* of the trumpet 25*j* and faces toward a vehicle side in the vehicle left-right direction, and the sonic outlet portion 25*c* is provided in the wall surface that defines the sonic passage 25*g* of the trumpet portion 25*j* and faces toward a vehicle side opposite to the sonic outlet portion 25*b* in the vehicle left-right direction. That is, the sonic outlet portions 25*b* and 25*c* are provided in the wall surfaces of the trumpet portion 25*j* to be opposite to each other. In this case, the sonic outlet portions 25*b* and 25*c* are open in the vehicle left and right directions which are different from each other, thereby improving the sonic pressure in the vehicle front side and reducing the amount of the foreign material entering the resonance tube 25.

In the example of FIG. 7, the sonic outlet portion 25*b* may be provided in a wall surface facing toward a vehicle front side, in the wall surface defining the sonic passage 25*g* of the trumpet portion 25*j*.

Furthermore, in the example of FIG. 7, the sonic outlet portion 25*c* may be provided in a wall surface that defines the sonic passage 25*g* of the trumpet portion 25*j* and faces toward a vehicle side in the vehicle left-right direction. Alternatively, in the example of FIG. 7, the sonic outlet portion 25*c* may be provided in a wall surface that defines the sonic passage 25*g* of the trumpet portion 25*j* and faces toward a vehicle rear side. Alternatively, in the example of FIG. 7, the sonic outlet portion 25*c* may be provided in a wall surface that defines the sonic passage 25*g* of the trumpet portion 25*j* and faces toward a vehicle front side.

In the example of FIG. 8, the sonic outlet portion 25*c* may be provided in a wall surface that defines the sonic passage 25*g* of the trumpet portion 25*j* and faces toward a vehicle front side.

Second Embodiment

A second embodiment of the present invention will be described with reference to FIGS. 9A to 10B. In the second embodiment and modifications thereof, the parts having functions similar to or corresponding to those of the electrical horn in the above-described first embodiment are indicated by the same reference numbers, and the detail explanation thereof is omitted.

Figure 9A:
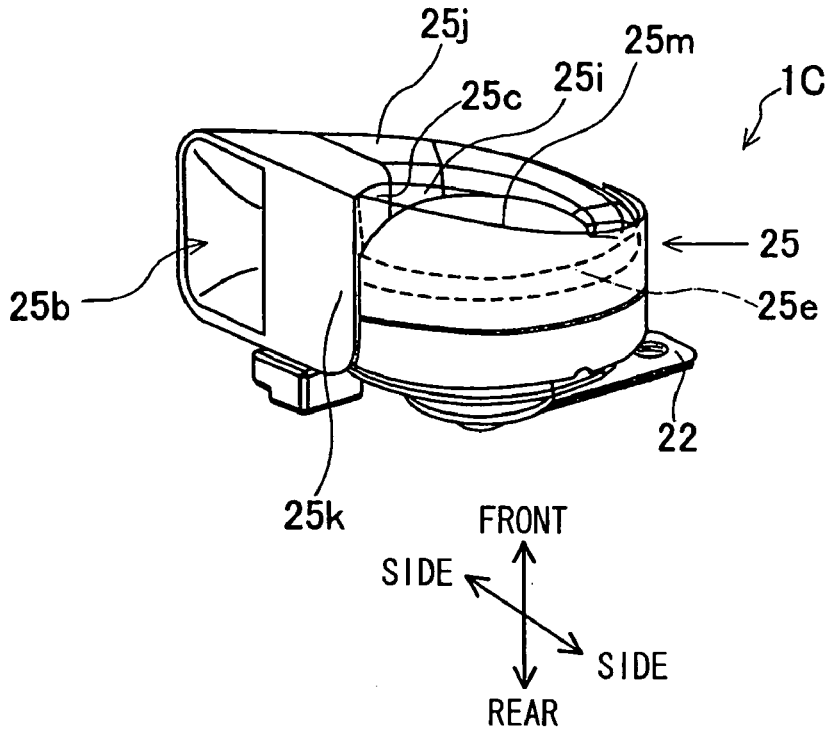
FIGS. 9A and 9B are a perspective view and a front view showing an electrical horn according to a second embodiment of the present invention.
Figure 9B:
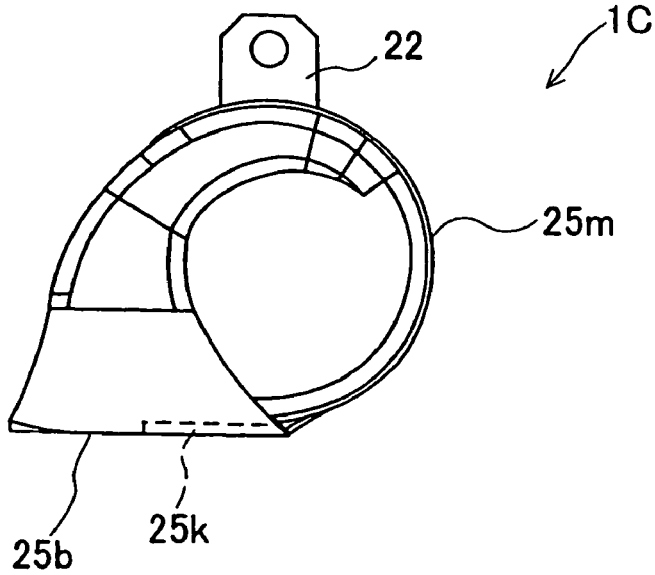

FIGS. 9A and 9B show an example of an electrical horn 1C of the second embodiment, in which a wall part 25*m* protruding from the parallel wall portion 25*e* is provided. The wall part 25*m* is arranged, such that a lower portion of the wall part 25*m* is wound on an outer peripheral surface of a part of the parallel wall portion 25*e* and an upper portion of the wall part 25*m* protrudes from the parallel wall portion 25*e* to the vehicle front side. The protruding dimension of the wall part 25*m* is gradually increased toward the tip end portion of the trumpet portion 25*j* in a circumferential direction, opposite to the orthogonal wall surface 25*i*. One side end portion of the wall part 25*m* having the largest protruding dimension is fixed to an end portion of the trumpet portion 25*j* with the largest protruding dimension of the orthogonal wall surface 25*i*, and the other side end portion of the trumpet portion 25*j* is fixed to an outside of a wall surface of the trumpet portion 25*j* at a position opposite to the orthogonal wall surface 25*i*, near a protruding start of the orthogonal wall surface 25*i*. That is, the protruding dimension of the wall portion 25*m* is gradually increased toward the tip end portion of the trumpet portion 25*j* in a first circumferential direction on a part of the parallel wall portion 25*e*, and the protruding dimension of the orthogonal wall surface 25*i* is gradually increased toward the tip end portion of the trumpet portion 25*j* in a second circumferential direction opposite to the first circumferential direction on another part of the parallel wall portion 25*e*.

In the electrical horn 1C of the second embodiment, because the wall part 25*m* protruding from the parallel wall portion 25*e* toward the vehicle front side is provided, the foreign material entering from the sonic outlet portion 25*c* can be reduced by the wall part 25*m*. Furthermore, because the wall part 25*m* protrudes from the parallel wall portion 25*e*, the sonic wave flowing out of the sonic outlet portion 25*c* can be reflected by the wall part 25*m*, thereby further increasing the sonic pressure in the vehicle front direction.

In the example of the electrical horn 1C shown in FIGS. 9A and 9B, the shielding plate 25*k* is provided to close a part of the sonic outlet portion 25*b* at the tip end portion of the trumpet portion 25*j*. However, in the example of the electrical horn 1C, the shielding plate 25*k* may be not provided.

Figure 10A:
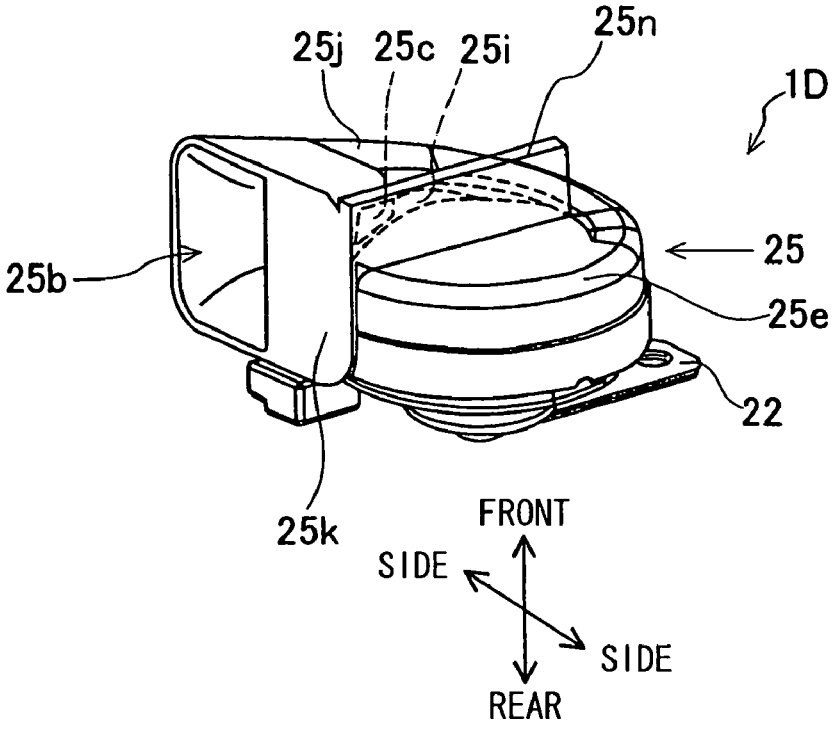
FIGS. 10A and 10B are a perspective view and a front view showing another example of an electrical horn according to the second embodiment of the present invention.
Figure 10B:
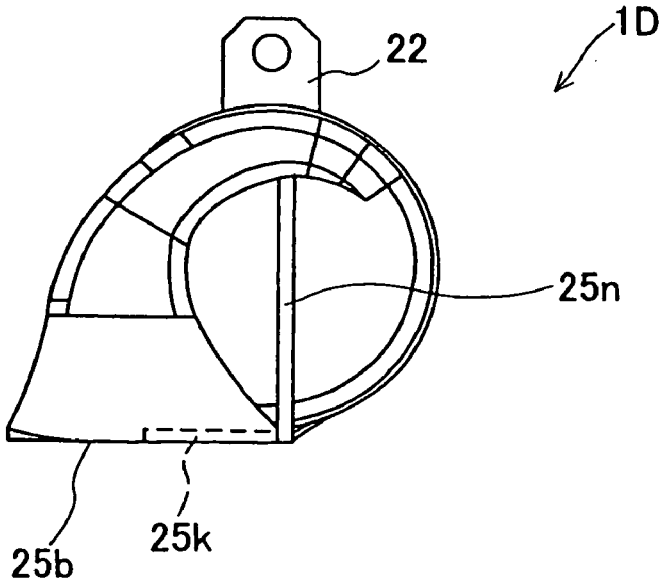

FIGS. 10A and 10B show another example of an electrical horn 1D according to the second embodiment. In the electrical horn 1D shown in FIGS. 10A and 10B, a wall part 25*n* protrudes approximately from an outer surface of the parallel wall portion 25*e* toward a vehicle front side approximately at a center portion. The wall part 25*n* has the same protruding dimension in the entire length of the wall part 25*n*, and the protruding dimension of the wall part 25*n* is approximately equal to the largest protruding dimension of the orthogonal wall surface 25*i*. One side end portion of the wall part 25*n* is fixed to the end portion of the orthogonal wall surface 25*i* having the largest protruding dimension, and the other side end portion of the wall part 25*n* is fixed to the parallel wall portion 25*e*. The protruding dimension of the wall part 25*n* may be set different from the largest protruding dimension of the orthogonal wall surface 25*i*, and the extending direction of the wall part 25*n* may be different from the example of the FIGS. 10A and 10B.

Because the wall part 25*n* is provided to face the sonic outlet portion 25*c* and extends to pass the center position of the parallel wall portion 25*e*, a distance between the wall part 25*n* and the sonic outlet portion 25*c* can be made shorter. Accordingly, the sonic wave discharged from the sonic outlet portion 25*c* can be reflected by the wall part 25*n*, thereby increasing the sonic pressure toward the vehicle front side. Furthermore, foreign material introduced from the sonic outlet portion 25*c* can be reduced by the wall part 25*n*.

Third Embodiment

A third embodiment of the present invention will be described with reference to FIGS. 11A and 11B. In the third embodiment and modifications thereof, the parts having functions similar to or corresponding to those of the electrical horn in the above-described embodiments are indicated by the same reference numbers, and the detail explanation thereof is omitted.

Figure 11A:
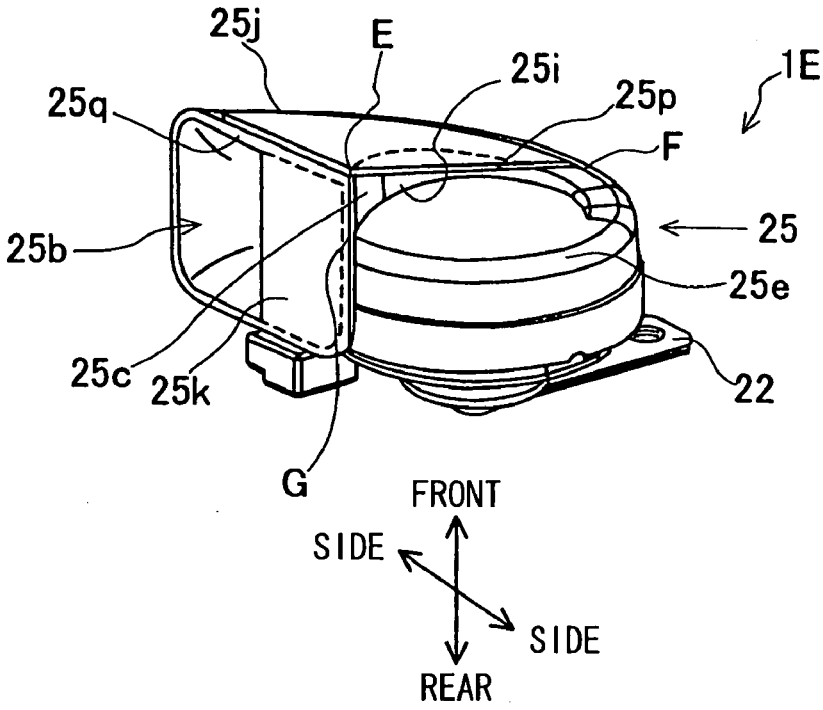
FIGS. 11A and 11B are a perspective view and a front view showing an electrical horn according to a third embodiment of the present invention.
Figure 11B:
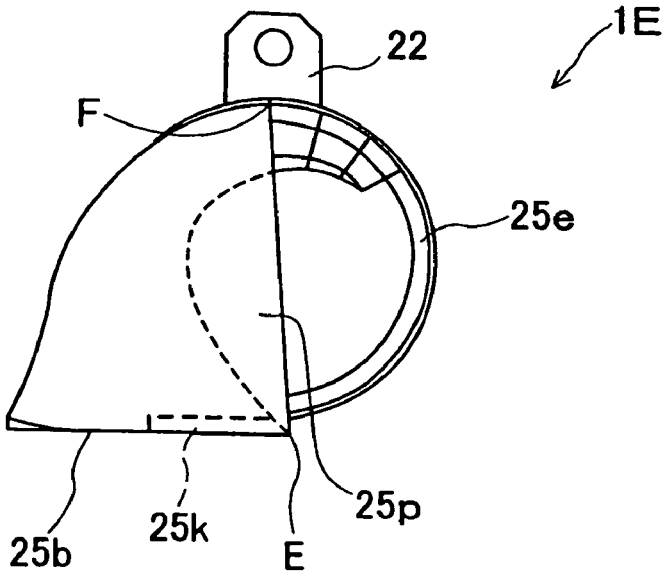

FIGS. 11A and 11B show an example of an electrical horn 1E of the third embodiment, in which a cover part 25*p* is provided to cover a part of a front side of the parallel wall portion 25*e*. As shown in FIGS. 11A and 11B, the cover part 25*p* protrudes from a wall surface 25*q* of the trumpet portion 25*j* approximately in parallel with the wall surface 25*q*. The wall surface 25*q* protrudes in the trumpet portion 25*j* to face the vehicle front side, and is approximately perpendicular to the orthogonal wall surface 25*i*.

In the electrical horn 1E of the example of FIGS. 11A and 11B, the cover part 25*p* protrudes from the wall surface 25*q* of the trumpet portion 25*j* and covers a part of the front surface of the trumpet portion 25*j*. Therefore, the foreign material entering from the sonic outlet portion 25*c* that is open toward the vehicle side can be reduced. Furthermore, the cover part 25*p*, the parallel wall portion 25*e* and the orthogonal wall surface 25*i* are configured to form approximately a triangular opening EFG open toward a vehicle side in the vehicle right-left direction. Therefore, the sonic wave flowing out of the sonic outlet portion 25*c* is amplified and then flows out of the triangular opening EFG toward the vehicle front side.

In the example of the electrical horn 1E shown in FIGS. 11A and 11B, the shielding plate 25*k* is provided to close a part of the sonic outlet portion 25*b* at the tip end portion of the trumpet portion 25*j*. However, in the example of the electrical horn 1E, the shielding plate 25*k* may be not provided.

Fourth Embodiment

A fourth embodiment of the present invention will be described with reference to FIGS. 12A and 12B. In the fourth embodiment and modifications thereof, the parts having functions similar to or corresponding to those of the electrical horn in the above-described embodiments are indicated by the same reference numbers, and the detail explanation thereof is omitted.

Figure 12A:
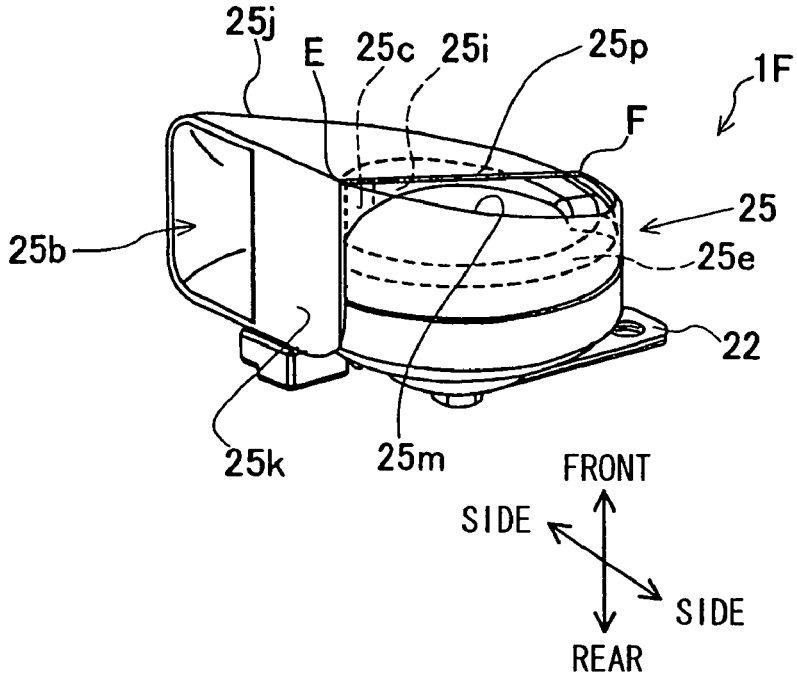
FIGS. 12A and 12B are a perspective view and a front view showing an electrical horn according to a fourth embodiment of the present invention.
Figure 12B:
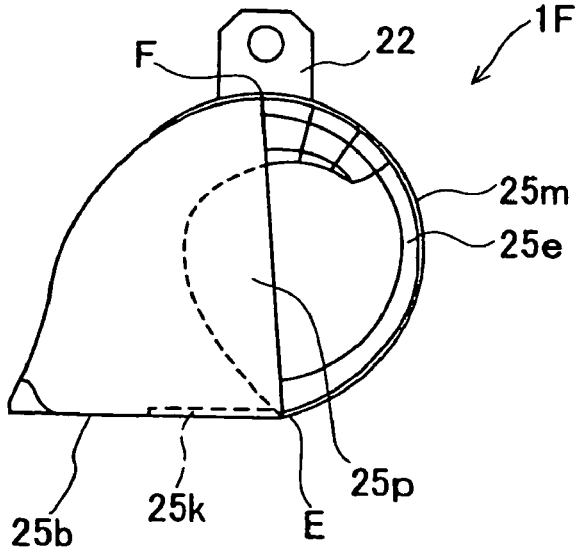

FIGS. 12A and 12B show an example of an electrical horn 1F of the fourth embodiment, in which the cover part 25*p* is provided to cover a part of the front side of the parallel wall portion 25*e* so as to form a triangular opening by the cover part 25*p*, the parallel wall portion 25*e* and the orthogonal wall surface 25*i*, similarly to the above-described third embodiment. Furthermore, the electrical horn 1F is provided with the wall part 25*m*, similarly to the example of FIGS. 9A and 9B.

In the example of the electrical horn 1F, because the wall part 25*m* and the cover part 25*p* are provided, foreign material entering into the resonance tube 25 from the sonic outlet portion 25*c* can be reduced. Furthermore, because a semicircular opening is formed by a straight end portion EF of the cover part 25*p* and a semicircular end portion EF of the wall part 25*m*, and is larger than the opening of the sonic outlet portion 25*c*. Thus, the sonic wave flowing out of the sonic outlet portion 25*c* is amplified and then flows out of the semicircular opening toward the vehicle front side. Accordingly, the sonic pressure toward the vehicle front side can be further increased.

In the example of the electrical horn 1F shown in FIGS. 12A and 12B, the shielding plate 25*k* is provided to close a part of the sonic outlet portion 25*b* at the tip end portion of the trumpet portion 25*j*. However, in the example of the electrical horn 1E, the shielding plate 25*k* may be not provided.

Although the present invention has been fully described in connection with the preferred embodiments thereof with reference to the accompanying drawings, it is to be noted that various changes and modifications will become apparent to those skilled in the art.

For example, in the above-described embodiments and modification thereof, at least two examples may be suitably combined when there are no a contradiction.

In the above-described embodiments and modifications thereof, the two sonic outlet portions 25*b* and 25*c* are provided in the resonance tube 25 to be open in different directions. However, a plurality of the sonic outlet portions more than two may be provided in the resonance tube 25 such that at least two of the sonic outlet portions are open in different directions. For example, the sonic outlet portion 25*b* is provided at the tip end portion of the resonance tube 25 (trumpet portion 25*j*), and the sonic outlet portions 25*c* can be provided at wall surfaces of the resonance tube 25, facing in different directions.

In an electrical horn that includes a horn housing (10), an oscillation member (11) fixed to the horn housing (10, 25) to generate a sonic wave and a resonance tube (25) for resonance of the generated sonic wave, when the resonance tube (25) has plural sonic outlets (25*b*, 25*c*) opened in different directions, the other structures and shapes of the electrical horn can be suitably changed.

Such changes and modifications are to be understood as being within the scope of the present invention as defined by the appended claims.

What is claimed is:

1. An electrical horn comprising:

a horn housing;

an oscillation member fixed to the horn housing to generate a sonic wave; and a resonance tube in which the sonic wave generated by the oscillation member flows, wherein the resonance tube has a plurality of sonic outlet portions that are open in different directions, the oscillation member is an oscillation plate member located between the horn housing and a cover member that is spaced from the oscillation plate member to be approximately parallel with the oscillation plate member, the resonance tube includes a scroll portion defining a sonic passage between the cover member and a parallel wall portion extending approximately in parallel with the cover member, and a trumpet portion continuously extending from the scroll portion to define the sonic passage, a passage sectional area of the sonic passage of the scroll portion is gradually increased toward downstream, and a passage sectional area of the sonic passage of the trumpet portion is rapidly increased, the trumpet portion has an orthogonal wall surface that extends from the parallel wall portion approximately perpendicularly to a surface of the parallel wall portion to define the sonic passage, and at least two of the sonic outlet portions are open in the trumpet portion to face in different directions.

2. The electrical horn according to claim 1, wherein the plurality of sonic outlet portions are two sonic outlet portions that are open respectively in two wall surfaces of the resonance tube, facing in different directions.

3. The electrical horn according to claim 1, wherein at least one of the sonic outlet portions is provided with plural openings.

4. The electrical horn according to claim 1, wherein one of the sonic outlet portions is open at a tip end of the trumpet portion, and the other one of the sonic outlet portions is open in the orthogonal wall surface, the electrical horn further comprising a shielding plate located to cover a part of the one sonic outlet portion provided at the tip end of the trumpet portion.

5. The electronic horn according to claim 4, wherein the shielding plate covers a part of the one sonic outlet portion at the tip end of the trumpet portion, on a side near the sonic outlet portion provided in the orthogonal wall surface.

6. The electrical horn according to claim 1, wherein a tip end of the trumpet portion is fully closed, and one of the sonic outlet portions is open in the orthogonal wall surface of the trumpet portion, and the other one of the sonic outlet portions is open in a wall surface of the trumpet portion, other than the orthogonal wall surface.

7. The electrical horn according to claim 1, wherein the resonance tube includes a protruding wall part protruding from the parallel wall portion approximately perpendicularly to a surface of the parallel wall portion to be opposite to the orthogonal wall surface.

8. The electrical horn according to claim 7, wherein the orthogonal wall surface is provided in a part of the parallel wall portion such that a protruding dimension protruding from the parallel wall portion is gradually increased as toward a tip end of the trumpet portion in a first circumferential direction, and the protruding wall part is provided in a part of the parallel wall portion such that a protruding dimension protruding from the parallel wall portion is gradually increased as toward the tip end of the trumpet portion in a second circumferential direction opposite to the first circumferential direction.

9. The electrical horn according to claim 1, wherein the trumpet portion includes a cover part that protrudes from a wall surface approximately perpendicular to the orthogonal wall surface and covers a part of the parallel wall portion.

10. The electrical horn according to claim 9, wherein the orthogonal wall surface and the cover part are configured together with the parallel wall portion to define an opening.

11. The electrical horn according to claim 10, wherein the resonance tube includes a protruding wall part protruding from the parallel wall portion approximately perpendicularly to a surface of the parallel wall portion to be opposite to the orthogonal wall surface, and the cover part and protruding wall part define an opening that is larger than an open area of the sonic outlet portion provided in the orthogonal wall surface.

12. An electrical horn comprising:

a horn housing;

an oscillation member fixed to the horn housing to generate a sonic wave; and a resonance tube in which the sonic wave generated by the oscillation member flows, wherein the resonance tube has a plurality of sonic outlet portions that are open in different directions, the resonance tube includes a scroll portion defining a sonic passage, and a trumpet portion continuously extending from the scroll portion to define the sonic passage, the scroll portion has a parallel wall portion parallel with the oscillation member, the trumpet portion has an orthogonal wall surface that extends from the parallel wall portion perpendicularly to a surface of the parallel wall portion to define the sonic passage, one of the sonic outlet portions is open at a tip end of the trumpet portion, and the other one of the sonic outlet portions is open in the orthogonal wall surface of the trumpet portion, and the parallel wall portion is configured to reflect a part of sonic wave flowing out of the other one of the sonic outlet portions.

13. The electrical horn according to claim 12, wherein the other one of the sonic outlet portions is located to face the scroll portion.

14. The electrical horn according to claim 12, wherein the other one of the sonic outlet portions is located upstream of the one of the sonic outlet portions in a flowing direction of the sonic wave in the sonic passage.

15. An electrical horn comprising:

a horn housing;

an oscillation member fixed to the horn housing to generate a sonic wave; and a resonance tube in which the sonic wave generated by the oscillation member flows, wherein the resonance tube has a plurality of sonic outlet portions that are open in different directions, the resonance tube includes a scroll portion defining a sonic passage, and a trumpet portion continuously extending from the scroll portion to define the sonic passage, the scroll portion has a parallel wall portion parallel with the oscillation member, one of the sonic outlet portions is open at a tip end of the trumpet portion, and the other one of the sonic outlet portions is open in a wall surface of the trumpet portion that is perpendicular to a surface of the parallel wall portion.

16. The electrical horn according to claim 15, wherein the other one of the sonic outlet portions is located to face the scroll portion.

17. The electrical horn according to claim 15, wherein the other one of the sonic outlet portions is located upstream of the one of the sonic outlet portions in a flowing direction of the sonic wave in the sonic passage.

18. The electrical horn according to claim 15, wherein the parallel wall portion is configured to reflect a part of sonic wave flowing out of the other one of the sonic outlet portions.

19. The electrical horn according to claim 15, wherein the wall surface of the trumpet portion extends from the parallel wall portion perpendicularly to a surface of the parallel wall portion, and the other one of the sonic outlet portions is open in the wall surface of the trumpet portion.

20. The electrical horn according to claim 15, wherein the wall surface of the trumpet portion extends from the parallel wall portion perpendicularly to a surface of the parallel wall portion, and the other one of the sonic outlet portions is open in a wall surface of the trumpet portion, other than the wall surface.

* * * * *